US005709311A

United States Patent [19]

Butler et al.

[11] Patent Number: 5,709,311

[45] Date of Patent: Jan. 20, 1998

[54] METHOD AND APPARATUS FOR REMOVING AND STORING A CONTAINER SEAL

[75] Inventors: Brett Butler, Dublin; David A. Wustner; Judith R. Epstein, both of Walnut Creek, all of Calif.

[73] Assignee: Valent USA Corporation, Walnut Creek, Calif.

[21] Appl. No.: 552,830

[22] Filed: Nov. 3, 1995

[51] Int. Cl.[6] ..... B65D 17/44

[52] U.S. Cl. ..... 220/278; 215/228; 220/212; 220/254; 220/256; 220/255; 222/81

[58] Field of Search ..... 215/228, 257, 215/296, 297; 206/222; 220/212, 278, 277, 254, 521, 255, 256, 522; 222/80, 81, 83, 83.5, 85

[56] References Cited

U.S. PATENT DOCUMENTS

| | | | |
|---|---|---|---|
| 1,918,243 | 7/1933 | Bergaud | 220/521 X |
| 2,620,789 | 12/1952 | Gregory | 220/521 X |
| 2,629,508 | 2/1953 | Prager | 220/521 X |
| 2,633,264 | 3/1953 | Dinsmore et al. | 220/256 X |
| 2,766,796 | 10/1956 | Tupper | 220/521 |
| 3,070,275 | 12/1962 | Bostrom | 220/521 X |
| 3,288,178 | 11/1966 | Johnson | 215/225 X |
| 3,367,484 | 2/1968 | Nelson | 220/521 X |
| 3,446,179 | 5/1969 | Bender | 220/521 X |
| 3,581,605 | 6/1971 | Taylor | 215/297 X |
| 4,709,822 | 12/1987 | Vataru | 215/216 |
| 4,723,687 | 2/1988 | Kutterer | 222/83 |
| 5,388,729 | 2/1995 | Gerringer | 220/521 X |
| 5,505,326 | 4/1996 | Junko | 220/278 |

OTHER PUBLICATIONS

Advertisement: M.J. Cyr & Co. "Sealbreaker" Hand Tool #246 (undated).

*Primary Examiner*—Allan N. Shoap
*Assistant Examiner*—Robin A. Hylton
*Attorney, Agent, or Firm*—Limbach & Limbach L.L.P.

[57] ABSTRACT

A container cap having cutting elements and a recess for removing and storing a container seal. The cutting elements are positioned within the recess and a lid covers the recess. After removing the cap, the cap is inverted so that the cutting elements pierce the seal. The cap is then rotated to cut the seal. The lid is then replaced thereby storing the seal within the recess.

12 Claims, 2 Drawing Sheets

METHOD AND APPARATUS FOR REMOVING AND STORING A CONTAINER SEAL

BACKGROUND OF THE INVENTION

The present invention is directed to a method and apparatus for removing a seal on a container. Removable seals, such as induction seals, are often used to seal containers to prevent spillage, oxidation, and evaporation of the contents. Removable seals also assure the user that the contents have not been tampered with.

When the container is opened for the first time, the seal is removed by puncturing a hole in the seal and manually tearing the seal from the container. The seal is then discarded.

A problem which occurs when removing the seal is that the user contacts the exposed side of the seal when tearing the seal from the container. This presents obvious problems when the container holds pesticides, solvents, pharmaceuticals and the like.

Another problem associated with removable seals is that the seals must be discarded after being removed thereby presenting another potential exposure problem. If the seal is not disposed of properly, a child or pet may be exposed to the contents coated on the seal.

SUMMARY OF THE INVENTION

The present invention solves the problems with conventional removable seals by providing a container cap which can be used to remove and store the container seal. As will be described below, the cap has a seal cutter for cutting the seal. The cap also includes a recess for storing the seal after removal. The cap of the present invention can be used to remove the seal without requiring the user to touch the seal.

The cap preferably includes conventional threads which engage the container for sealing the container opening. Although the preferred cap has threads, the cap may engage the container with a bayonet, snap-fit, child-resistant or any other conventional connection.

The seal cutter is disposed in the recess. The recess in the top of the cap and is defined by a sidewall and a bottom surface. The recess is covered by a removable lid for sealing the recess and preventing the user from being injured by the seal cutter. The lid preferably has a snap-fit engagement with the sidewall.

The seal cutter preferably includes a number of cutting elements. Each cutting element includes a ledge which extends substantially parallel to the bottom surface. The ledge helps hold the seal after the seal has been completely severed from the container. The cap also preferably includes a post extending from the bottom surface to help retain the seal within the recess. The cutting elements are preferably positioned radially outward from the centrally-located post.

The present invention is also directed to a method of removing a container seal, wherein a cap according to the invention is disengaged from the container and the lid is disengaged from the cap. The cap is then inverted and pressed downwardly onto the seal so that the seal cutter punctures the seal.

The cap is then rotated so that the cutting elements cut the seal. After the cap has been rotated a sufficient amount, the cap is lifted from the container with the seal being retained within the recess by the cutting elements and post. The lid is then replaced enclosing the seal in the recess. In this manner, the user is not exposed to the contents of the container and the seal is disposed of quickly and efficiently.

Other features and advantages of the invention will appear from the following description in which the preferred embodiments have been set forth in conjunction with the accompanying drawings.

BRIEF DESCRIPTION OF THE DRAWINGS

The invention will be better understood by reference to the attached drawings of which.

DESCRIPTION OF THE PREFERRED EMBODIMENTS

Figure 1:
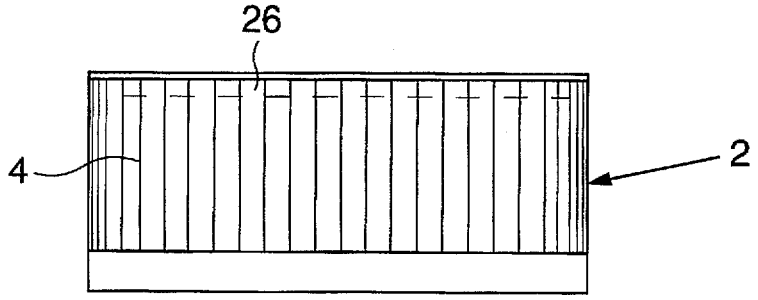
FIG. 1 is a side view of a cap constructed in accordance with the principles of the present invention.

Referring to FIG. 1, a side view of a cap 2 constructed in accordance with the principles of the present invention is shown. An exterior surface 4 of the cap 2 is faceted for easy gripping. Naturally, the exterior surface 4 may include any other feature such as ribs. A lid 26, removable to access the cutters of the cap, is shown in dashed lines in FIG. 1.

Figure 4:
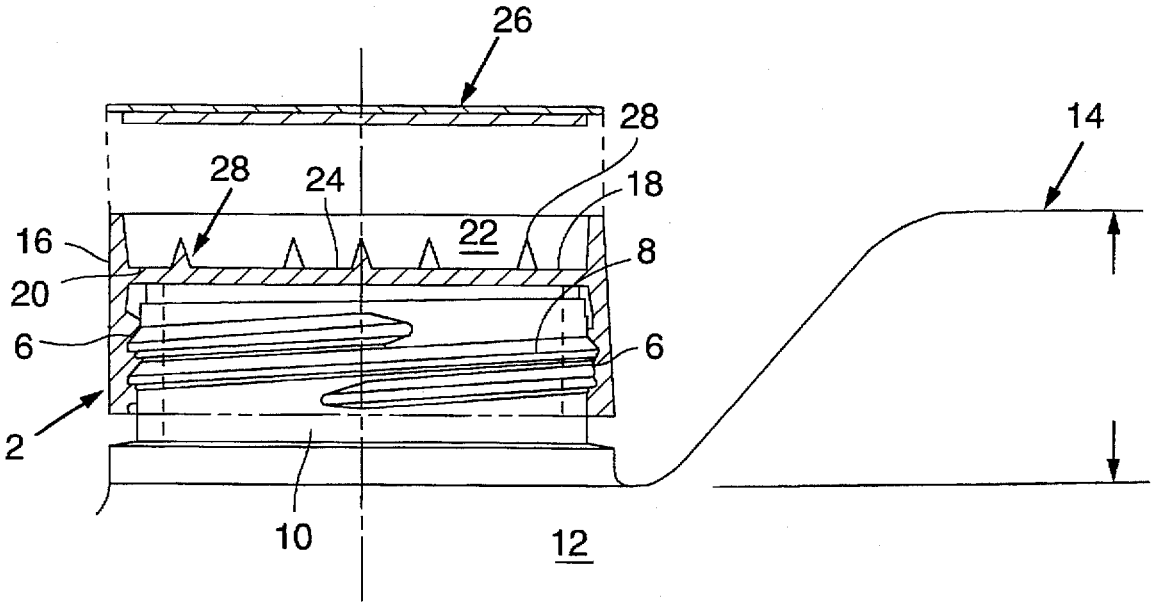
FIG. 4 is a partial cross-sectional side view of the cap of the invention engaged with a container.

Referring to the partial cross-sectional view of FIG. 4, the cap 2 includes threads 6 which engage threads 8 on a container opening 10 on a container 12, which has a container handle 14. In one embodiment, the cap is sized to fit a standard 63 mm diameter container opening. As discussed above, the cap 2 and container opening 10 may engage one another with any conventional connection.

The cap 2 covers container opening 10 which has a seal, such as an induction seal, which prevents spillage, oxidation and evaporation of the contents. The cap 2 has a sidewall 16 and an intermediate wall 18 which closes container opening 10 for sealing the container after the container seal is removed. Intermediate wall 18 has a perimeter 20 which engages sidewall 16.

A recess 22 is defined by sidewall 16 and a bottom surface 24 of intermediate wall 18. Lid 26 covers recess 22 and engages sidewall 16 with a snap-fit connection, however, any other conventional connection may be used. Lid 26 prevents injury from the cutting elements and seals recess 22.

A number of cutting elements 28, preferably at least two and more preferably at least eight, extend from the bottom surface of the recess.

Figure 2:
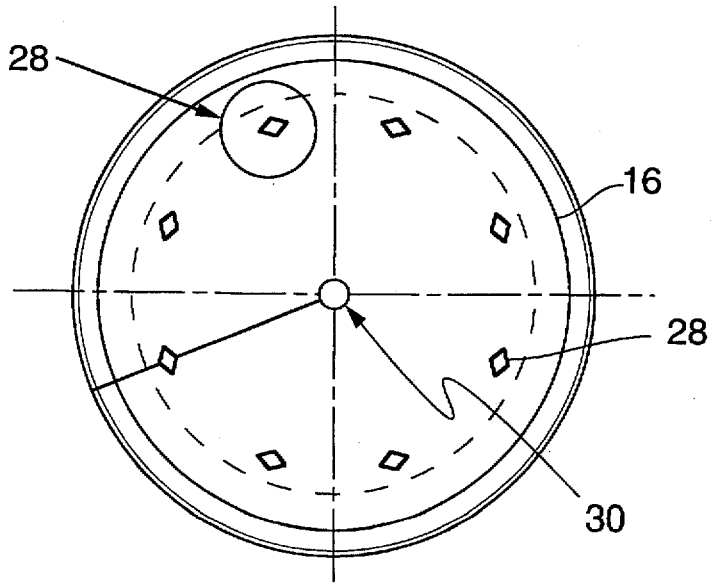
FIG. 2 is a plan view of the cap showing a recess containing cutting elements and a post.

Referring to FIG. 2, cutting elements 28 are spaced apart from one another and are positioned near sidewall 16. A post 30 extends from a central location on bottom surface 24 to help retain the container seal within recess 22.

Figure 3A:
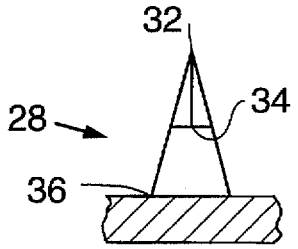
FIGS. 3A–3C show enlarged views of one of the cutting elements.
Figure 3B:
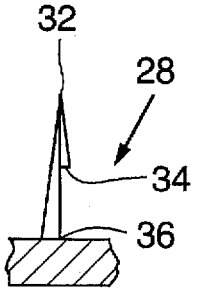
Figure 3C:
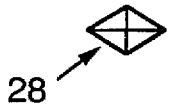

Referring to FIGS. 3A–3C, enlarged views of one of the cutting elements 28 are shown. Referring to FIG. 3C, cutting element 28 is pointed and has four sides which terminate at a tip 32. Referring to FIG. 3A, the cutting element 28 has a triangular shape when viewed in a radially-inward direction. Referring to FIG. 3B, one side of the cutting element 28 includes a ledge 34 which helps retain the container seal during removal. The ledge 34 is positioned between a base 36 and tip 32 of cutting element 28. Ledge 34 prevents the seal from falling into the container opening 10 after the seal has been completely cut from the container opening. Ledge 34 preferably extends substantially parallel to the bottom surface but may be sloped no more than 30° or, more preferably, no more than 10°. Ledge 34 is preferably provided on the radially-outward side of cutting elements 28.

Use of the preferred cap 2 is now described. The cap 2 is disengaged from the container opening 10 and lid 26 is removed to expose cutting elements 28 in recess 22. The cap 2 is inverted and pressed onto container opening 10 so that post 30 and cutting elements 28 pierce the seal. The cap 2 is then rotated to cut the seal. After rotating the cap 2 a sufficient amount, cap 2 is removed with the seal retained in recess 22 by cutting elements 28 and post 30. Lid 26 is then replaced thereby enclosing the seal in recess 22. Recess 22 is preferably completely sealed by lid 26 so that exposure to the seal cannot occur.

Modifications and variations can be made to the disclosed embodiments without departing from the subject of the invention as defined by the following claims. For example, a single cutting element may be provided or the lid may be provided with a locking mechanism so that the lid cannot be removed a second time.

We claim:

1. A method of removing a seal on a container, comprising the steps of:

providing a cap configured to engage a container, the container having a seal covering an opening, the cap having a lid covering a recess and a seal cutter disposed within the recess;

disengaging the cap from the container;

disengaging the lid from the cap;

puncturing the seal with the seal cutter;

rotating the cap after the puncturing step so that the seal cutter cuts and retains the seal;

replacing the lid after the rotating step thereby enclosing the seal in the recess; and coupling the cap to the container.

2. The method of removing a seal on a container of claim 1, wherein:

the cap disengaging step is accomplished by rotating the cap.

3. The method of removing a seal on a container of claim 1, wherein:

the providing step is carried out with the cap having a post extending from a bottom surface of the recess, the post being configured to retain the seal in the recess.

4. The method of removing a seal on a container of claim 1, wherein the providing step is carried out with a cap having a seal cutter which includes a plurality of cutting elements, the cutting elements extending from a bottom surface of the recess.

5. The method of removing a seal on a container of claim 4, wherein the providing step is carried out with a cap having a seal cutter with cutting elements of claim 4, wherein each cutting element includes a ledge for retaining the seal in the recess which extends substantially parallel to the bottom surface of the recess.

6. A cap for a container having a seal, comprising:

a sidewall having a top and a bottom;

an intermediate wall with a surface and having a perimeter engaging the sidewall at a position between the top and bottom of the sidewall;

a recess at least partially defined by the sidewall and intermediate wall;

a seal cutter including cutting elements extending from the intermediate wall and having a seal retaining ledge extending parrallel to said intermediate wall disposed within the recess; and a removable lid covering the recess.

7. The cap for a container having a seal of claim 6, further comprising a post extending from the intermediate wall and positioned within the recess.

8. The cap for a container having a seal of claim 6, wherein:

the seal cutter includes a plurality of cutting elements, the cutting elements extending from the intermediate wall.

9. The cap for a container having a seal of claim 6, wherein:

the lid has a snap-fit engagement with the sidewall and provides a substantially fluid-tight seal for the recess.

10. A cap for a container having a seal, comprising:

a sidewall having a top and a bottom and having a threaded surface configured to engage a container;

an intermediate wall with a surface and having a perimeter connected to the sidewall at a position between the top and bottom of the sidewall;

a recess at least partially defined by the sidewall and the intermediate wall;

a seal cutter having a plurality of cutting elements, the cutting elements extending from the intermediate wall and being disposed within the recess and wherein said cutting elements include a seal retaining ledge extending parallel to said intermediate wall;

a post extending from the intermediate wall and positioned within the recess; and a removable lid covering the recess, the removable lid having a snap-fit engagement with the sidewall.

11. A cap for a container having a seal, comprising:

a sidewall having a top and a bottom;

an intermediate wall with a surface and having a perimeter engaging the sidewall at a position between the top and bottom of the sidewall;

a recess at least partially defined by the sidewall and intermediate wall;

a seal cutter for cutting and retaining the seal and disposed within the recess and extending from the intermediate wall said seal cutter comprising a plurality of cutting elements, wherein each cutting element includes a ledge which extends substantially parallel to the intermediate wall surface; and a removable lid covering the recess.

12. A cap for a container having a seal, comprising:

a sidewall having a top and a bottom and having a threaded surface configured to engage a container;

an intermediate wall with a surface and having a perimeter connected to the sidewall at a position between the top and bottom of the sidewall;

a recess at least partially defined by the sidewall and the intermediate wall;

a seal cutter disposed within said recess and having a plurality of cutting elements, the cutting elements extending from the intermediate wall, wherein each cutting element includes a ledge which extends substantially parallel to the intermediate wall surface;

a post extending from the intermediate wall and positioned within the recess; and a removable lid covering the recess, the removable lid having a snap-fit engagement with the sidewall.

* * * * *